US008514084B2

(12) United States Patent
Yi

(10) Patent No.: US 8,514,084 B2
(45) Date of Patent: Aug. 20, 2013

(54) COOKING SYSTEM AND CONTROLLING METHOD FOR THE SAME

(75) Inventor: Soo Cheol Yi, Changwon (KR)

(73) Assignee: LG Electronics Inc., Seoul (KR)

( * ) Notice: Subject to any disclaimer, the term of this patent is extended or adjusted under 35 U.S.C. 154(b) by 491 days.

(21) Appl. No.: 12/523,382

(22) PCT Filed: Nov. 15, 2007

(86) PCT No.: PCT/KR2007/005752
§ 371 (c)(1),
(2), (4) Date: Jan. 21, 2010

(87) PCT Pub. No.: WO2008/088124
PCT Pub. Date: Jul. 24, 2008

(65) Prior Publication Data

US 2010/0134298 A1 Jun. 3, 2010

(30) Foreign Application Priority Data

Jan. 17, 2007 (KR) ..... 10-2007-0005323

(51) Int. Cl.

| | |
|---|---|
| ***G08B 23/00*** | (2006.01) |
| ***G08B 1/08*** | (2006.01) |
| ***G08B 13/14*** | (2006.01) |
| ***H04Q 5/22*** | (2006.01) |
| ***B60R 25/10*** | (2006.01) |
| ***H04B 1/00*** | (2006.01) |
| ***F25B 19/00*** | (2006.01) |
| ***F25B 49/00*** | (2006.01) |
| ***F25D 11/00*** | (2006.01) |
| ***F25D 17/06*** | (2006.01) |
| ***D06F 75/24*** | (2006.01) |
| ***F27D 11/00*** | (2006.01) |

(52) U.S. Cl.

USPC ..... 340/573.1; 340/10.1; 340/539.32; 340/426.36; 340/5.73; 340/572.1; 340/423.36; 62/231; 62/125; 62/440; 62/190; 219/254; 219/441

(58) Field of Classification Search

USPC ..... 340/572.1, 572.4, 572.5, 988, 10.1, 340/10.2, 10.3, 10.31, 10.4, 10.41, 10.42, 340/825.69, 825.71, 825.73, 825.31, 825.72, 340/539, 825.32, 10.5, 5.61, 5.72, 638, 310.01, 340/870.02, 573.1, 539.32, 426.36, 5.73; 235/375, 462.01, 472.01, 454, 379, 363, 235/467, 472, 380, 462, 383, 435, 492, 493; 709/201, 10; 707/10, 2; 62/231, 125, 440, 62/190, 331; 705/1, 26; 219/445.1, 702, 219/720

See application file for complete search history.

(56) References Cited

U.S. PATENT DOCUMENTS 5,317,134 A * 5/1994 Edamura ..... 219/720
5,611,327 A 3/1997 Filho et al.

(Continued)

FOREIGN PATENT DOCUMENTS

JP 2001-317741 A 11/2001
JP 2005-242628 A 9/2005

(Continued)

*Primary Examiner* — Jennifer Mehmood
*Assistant Examiner* — Mirza Alam
(74) *Attorney, Agent, or Firm* — Birch, Stewart, Kolasch & Birch, LLP

(57) ABSTRACT

A cooking system is provided to improve the safety and the reliability of the cooking system, and the convenience of a user. The cooking system includes at least one RF tag, a cooking appliance with an RF reader detecting the RF tag approaching, and an RF tag recognition button in a manipulation unit of the cooking system. The cooking appliance initiates a predetermined mode when the RF tag is detected. The RF tag recognition button determines whether the RF reader initiates an RF tag reading operation to recognize the RF tag.

19 Claims, 2 Drawing Sheets

(56) References Cited

U.S. PATENT DOCUMENTS

| | | | | |
|---|---|---|---|---|
| 6,137,095 | A * | 10/2000 | Kashimoto et al. | 219/702 |
| 7,096,221 | B2 * | 8/2006 | Nakano | 340/6.1 |
| 2002/0026325 | A1 * | 2/2002 | Hirahara et al. | 705/1 |
| 2002/0157411 | A1 * | 10/2002 | Ishikawa et al. | 62/231 |
| 2003/0192873 | A1 * | 10/2003 | Lerner | 219/445.1 |
| 2003/0233168 | A1 * | 12/2003 | Perin et al. | 700/236 |
| 2004/0145453 | A1 | 7/2004 | Tuttle | |
| 2004/0217859 | A1 * | 11/2004 | Pucci et al. | 340/539.32 |
| 2006/0114116 | A1 * | 6/2006 | Mullet et al. | 340/679 |
| 2006/0232383 | A1 * | 10/2006 | Yoon et al. | 340/10.2 |
| 2007/0125100 | A1 * | 6/2007 | Shoenfeld | 62/125 |
| 2007/0296563 | A1 * | 12/2007 | Higuchi et al. | 340/426.36 |

FOREIGN PATENT DOCUMENTS

| | | | |
|---|---|---|---|
| KR | 2003-0062030 | A | 7/2003 |
| KR | 10-2004-0091172 | A | 10/2004 |
| KR | 10-2005-0028472 | A | 3/2005 |
| KR | 10-2006-0062234 | A | 6/2006 |
| RU | 2 076 460 | C1 | 3/1997 |
| RU | 2 143 088 | C1 | 12/1999 |
| RU | 2 145 403 | C1 | 2/2000 |
| WO | WO-2005/006239 | A1 | 1/2005 |

* cited by examiner

Fig. 1
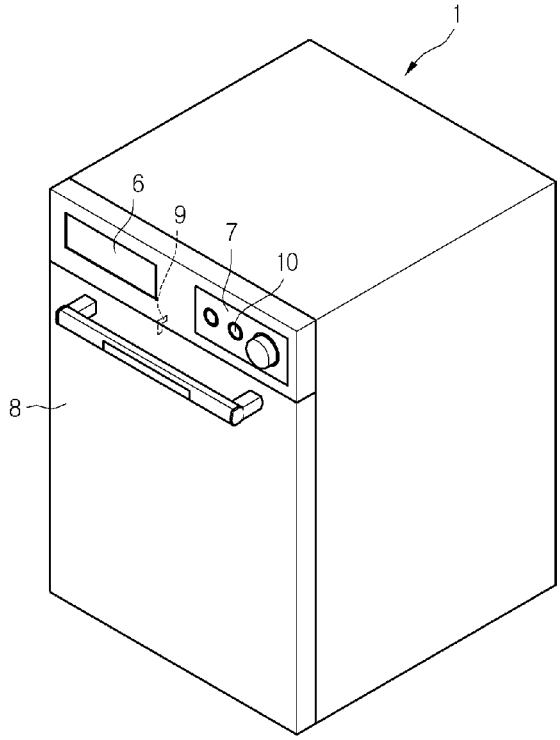
Fig. 2
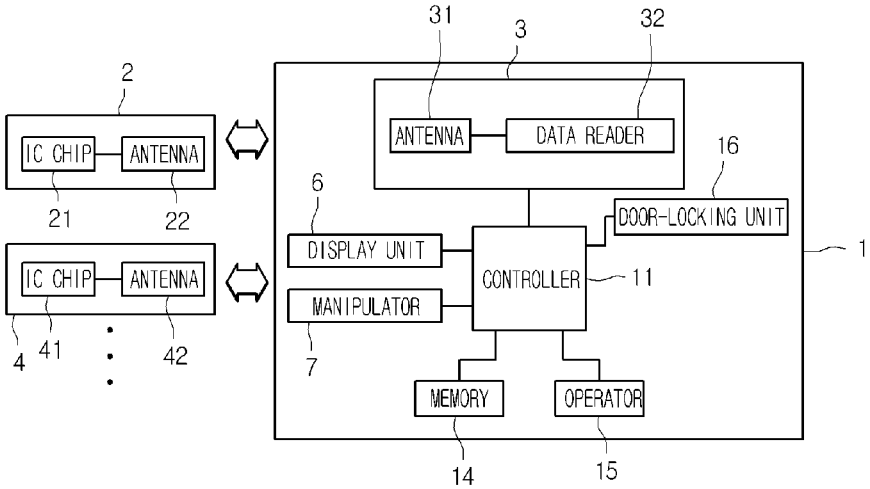
Fig. 3
| ADDRESS | FIELD NAME |
|---|---|
| 0 | START CODE |
| 1 | AUTHENTICATE CODE |
| 2 | USER ID |
| 3 | ERROR CODE |
| 4 | END CODE |

COOKING SYSTEM AND CONTROLLING METHOD FOR THE SAME

TECHNICAL FIELD

The present disclosure relates to a cooking system and a method for controlling the cooking system, and more particularly, to a cooking system and a method for controlling the cooking system which recognize a user approaching a cooking appliance, so that the user can use the cooking appliance more safely.

BACKGROUND ART

Generally, cooking appliances that cook food using a high heat are provided with various safety devices. Herein, an oven generating a high heat in a relatively narrow area will be exemplarily described for easy understanding. However, the spirit of the present disclosure will not be limited thereto, and can be applied to any appliance that may be a threat to a user's safety due to its heat source.

Exemplary safety devices will be described below. First, there is a door-locking device that prevents children from opening a door of a cooking appliance, thereby preventing an accidental opening of the door when the cooking appliance is highly heated in operation. For example, Korean Patent Application No. 10-2006-0104286 and No. 10-2006-0097805 disclose a door-locking device proposed by the applicant of the present disclosure.

As another exemplary safety device, there is a safety device that can prevent children from operating a cooking appliance while they accidentally press an operation button. This safety device may be enabled by a start signal such as pressing of a specific button for a prolonged duration. In this case, the safety device will not operate even though a button of a manipulation unit is pressed. However, this safety device has a limitation in that a user needs to manipulate the safety device.

Also, since the door-locking device is configured to operate only at a high temperature, the door-locking device may not be enabled until a cooking appliance is heated to a predetermined temperature while threatening safety to a user. In practice, although the cooking appliance is not heated to a high temperature, children may touch the cooking appliance and be injured by its high heat or its components.

DISCLOSURE OF INVENTION

Technical Problem

Embodiments provide a cooking system and a method for controlling the same by recognizing a user approaching a cooking appliance in order to determine whether to allow the user's operation or not.

Embodiments also provide a cooking system and a method for controlling the same, which allow a user to use a cooking appliance safely without separate manipulation of the user.

Technical Solution

In one embodiment, a cooking system includes: at least one radio frequency tag; a cooking appliance with an radio frequency reader detecting the radio frequency tag approaching, the cooking appliance initiating a predetermined mode when the radio frequency tag is detected; and a radio frequency tag recognition button in a manipulation unit of the cooking system, the radio frequency tag recognition button determining whether the radio frequency reader initiates a radio frequency tag reading operation to recognize the radio frequency tag.

In another embodiment, a cooking system includes: a radio frequency tag including a user identification; and a cooking appliance changing an operation mode for each radio frequency tag, the cooking appliance including: a radio frequency reader detecting approaching of the radio frequency tag; a memory in which a predetermined operation mode is designated for each user identification; and a controller matching the user identification read from the radio frequency reader with user identification stored in the memory, and differently controlling the cooking appliance according to a operation mode, and the operation mode including at least a warning mode.

In further another embodiment, a method for controlling a cooking system includes: recognizing a radio frequency tag; reading user information from the radio frequency tag; determining whether to operate a cooking appliance at least in a safety mode or in a warning mode using the user information; and operating the cooking appliance in the determined mode.

Advantageous Effects

A cooking system according to the embodiments of the present disclosure has the advantage of improving the safety and the reliability of the cooking system and the convenience of a user

BRIEF DESCRIPTION OF THE DRAWINGS

FIG. 1 is a perspective view of an oven according to an embodiment.

FIG. 2 is a block diagram of a cooking appliance according to an embodiment.

FIG. 3 is a table of information recorded in an RF tag.

BEST MODE FOR CARRYING OUT THE INVENTION

Figure 4:
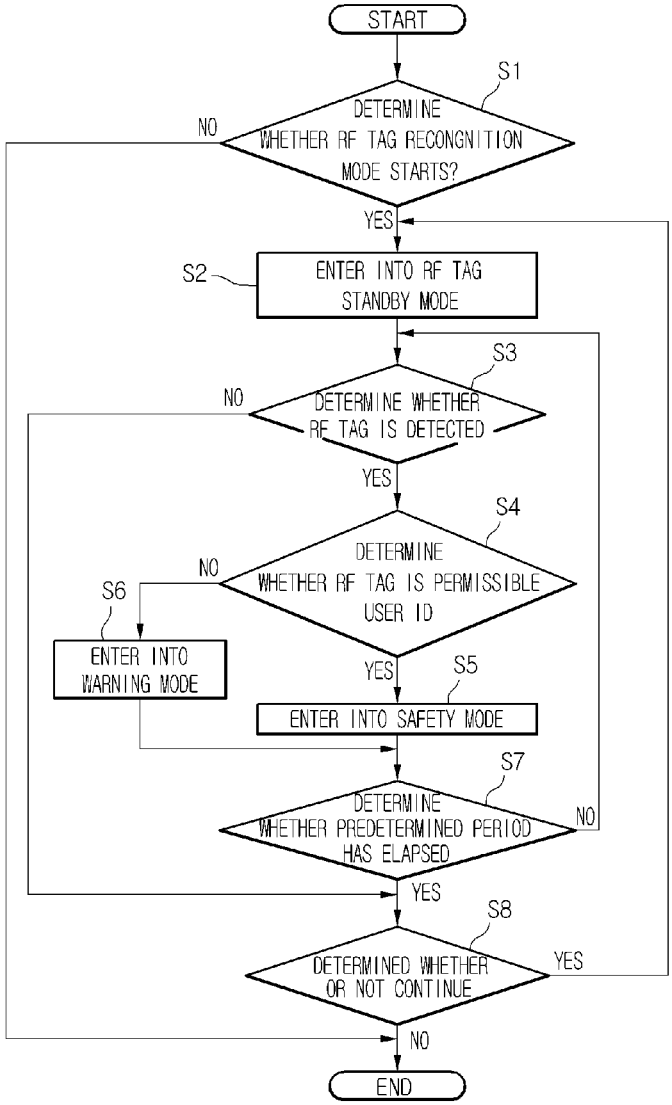
FIG. 4 is a flowchart of a method for controlling a cooking system according to an embodiment.

Reference will now be made in detail to the embodiments of the present disclosure, examples of which are illustrated in the accompanying drawings.

A cooking system according to embodiments is provided with an RF tag reading system including an RF tag and an RF reader. The RF tag reading system is embodied as the RF tag and the RF reader, in which the RF reader requests the RF tag for tag data, and then the RF tag transmits the tag data to the RF reader in the form of radio frequency. Hereinafter, unless a specific reference is mentioned, the RF tag reading system is considered to operate in the manner describe above. In this specification, an oven will be exemplarily described for a better understanding, but not limited thereto. Preferably, the spirit of the present disclosure is applicable to any other cooking appliance.

FIG. 1 is a perspective view of an oven according to an embodiment.

Referring to FIG. 1, an oven 1 includes a door 8, a display unit 6, a manipulator 7, and a door-locking unit 9. The door 8 opens and closes a cavity toward a forward direction of the oven 1. The display unit 6 is provided in a control panel at the upper side of the door 8, and displays an operation state of the oven 1. The manipulator 7 manipulates the operation of the oven 1. The door-locking unit 9 prevents a user from opening the door 8. A detail constitution of the door-locking unit 9 has been disclosed in the Korean Paten Application No. 10-2006-0104286 and No. 10-2006-0097805. Besides the above references, various modifications of the door-locking unit 9 have been disclosed so far. Herein, details of the door-locking unit 9 will be omitted from this specification.

According to embodiments, a specific button is further provided in the manipulator 7 of the oven 1.

The specific button is an RF tag recognition button 10, which initiates and terminates an operation of an RF tag reading system.

When the RF tag recognition button 10 is firstly pressed down, an RF tag reading system starts. When the RF tag recognition button 10 is secondly pressed down, the operation of the RF tag reading system is terminated. In this case, the starting operation may be operated by pressing button for a short or long duration, while the terminating operation may be operated only when the button is necessarily pushed down for a long duration. Accordingly, it is possible to prevent an accidental press by children. When the RF tag reading system starts, it is preferred that an operation state of the system be displayed on the display unit 6.

When the RF tag reading system starts to operate, the RF tag reading system is changed into a warning mode with respect to a danger group including children, etc, while the RF tag reading system is changed into a safety mode with respect to a safety group such as an adult. That is, the oven is safely operated by recognizing a user approaching the oven.

In the warning mode, the door-locking unit 9 may be automatically locked. In this case, the automatic locking function will be performed irrespective of whether the oven is under operation or not. Furthermore, a warning sound may be generated in the warning mode to alarm an adult. As the case may be, the oven may be powered off, so that the oven may stop.

In the safety mode, the door-locking unit is unlocked. In this case, the unlocking function may be performed irrespective of whether the oven is under operation or not. Nevertheless, it is preferred that the door 8 should not be opened at a higher temperature than a predetermined temperature even in the safety mode. Also, a message of a waiting status for use may be outputted, so that the user can use the oven 1 more conveniently. Although, in the waiting status, a power supply is usually supplied only to RF reader of the oven 1 to save power, the power supply may be fully supplied to the oven 1, so that the oven may enter into an operation preparatory stage.

On the other hand, for more smooth operation of the RF tag reading system according to embodiments, a distance range that RF tag reading system can recognize may be adjusted to be a very adjacent distance to the user. Accordingly, it is preventable that the oven 1 unexpectedly enters into the safety mode or the warning mode in a narrow area.

That is, since the recognizable distance range of the RF tag reader is adjustable, the user can use the oven more conveniently. For example, when only adults are in the house, the RF reader may be adjusted to be a more sensitive. As such, the RF tag reading system may detect a user approaching the cooking appliance easily. Then, The cooking appliance may output a predetermined message, and may enter into the standby mode for an order of the user.

FIG. 2 is a block diagram of a cooking appliance according to an embodiment.

Referring to FIG. 2, the cooking appliance 1 includes a controller 11, a manipulator 7, a display unit 6, a memory 14, an operating unit 15, and a door-locking unit 16. The controller 11 controls all operations of the cooking appliance 1. A user manipulates the cooking appliance 1 by means of the manipulator 7. The display unit 6 displays an operation state of the cooking appliance 1. The memory 14 includes operation information of the cooking appliance 1. The operator 15 includes a plurality of components as a heating source to heat the cooking appliance 1. In addition, an RF reader 3 is further provided to recognize an RF tag approaching the cooking appliance 1. The RF reader 3 includes an antenna 31, and a data reader 32. The data reader 32 reads information received from the RF tag via the antenna 31.

There are two types of RF tags, which are recognized through the antenna 31. A first RF tag 2 is recognized as a safety mode. A second RF tag 4 is recognized as a warning mode. The RF tag 2 and 4 are respectively provided with IC chips 21 and 41, and antennas 22 and 42.

The RF tags 2 and 4 contain some information, which is listed in FIG. 3. That is, a code for indicating start of data is recorded in a start code field. A code for indicating end of data is recorded in an end code field. A code used for authenticating the RF reader 3 is recorded in an authenticate code field. A code for verifying whether an error occurs in data transmission is recorded in an error code field.

Each of the code fields is fundamentally required to operate the RF tag reading system. However, types of the fields may vary in accordance with the concrete requirements of the RF tag reading system.

Besides the fundamental code fields describe above, a user ID may be recorded in a second address. The RF tag reading system may recognize the user ID to determine whether the cooking appliance 1 enters into a safety mode or a warning mode. In this case, the user ID field may include an immediate signal to indicate which mode the RF tag reading system should enter into among the warning mode and the safety mode.

Referring to the above constitution, a cooking system according to embodiments will be briefly described as follows.

When the first RF tag 2 approaches the RF reader 3, the RF reader 3 receives information from the first RF tag 2. Then, the data reader 32 reads out the information recorded in the first RF tag 2. More specifically, the user ID among information of the first RF tag 2 is read out. The first RF tag 2 may belong to a child.

After the user ID is read out, the user ID is transmitted to a controller 11. After the RF tag reading system determines whether the transmitted user ID matches one of the user Ids recorded in the memory 14, the RF tag reading system enters into a warning mode when the user ID matches one of the user Ids of children. In accordance with the user ID, modes, which the RF tag reading system enters into, are predefined in the memory 14.

As described above, when the cooking appliance 1 enters into the warning mode, various operations predefined in the warning mode will be performed in the cooking appliance 1. For example, it may be possible that the door-locking unit 16 is automatically operated to lock the door. Also, a warning image or a warning sound may be generated to inform the adults of the situation. Furthermore, the cooking appliance 1 may be powered off under a control of the controller 11. The operator 15 may terminate the operation of the cooking appliance 1. This case may be preferably applied to a cooking appliance 1 such as a gas range. Through controlling the manipulator 7 and the controller 11, the cooking appliance 1 will not be operated even when buttons of the manipulator 7 are pushed down.

The operations as describe above perform a function that prevents an accident which may happen to thoughtless persons such as children.

On the other hand, when the second RF tag 4 approaches the RF reader 3, the RF reader 3 receives information from the second RF tag 4, and then the data reader 32 reads out information recorded in the second RF tag 4. More specifically, the user ID among information of the second RF tag 4 is read out. The second RF tag 4 may belong to adults.

After the user ID is read out, the user ID is transmitted to a controller 11. After the RF tag reading system determines whether the transmitted user ID matches one of the user Ids recorded in the memory 14, the RF tag reading system enters into a safety mode when the user ID matches one of the user Ids of adults.

When the cooking appliance 1 enters into the safety mode, the door-locking unit 16 may be released to unlock the door 8. In this case, the door 8 may be opened regardless of whether or not the oven is under operation. However, it is preferred that the door 8 be configured to remain closed when the oven is at a high temperature higher than a predetermined temperature even in a safety mode. The display unit 6 may be controlled to display a message indicating a waiting status, so that a user can use the over more conveniently. Also, a power supply is applied to the oven, so that the oven may enter into an operation preparatory status. Furthermore, the user may preheat the operator 15 to operate the cooking appliance 1 more quickly.

As the case may be, the RF tags 2 and 4 may include a signal corresponding to the warning mode and a signal corresponding to the safety mode. In this case, the RF reader 3 may read the signal in itself received from the RF tags to determine whether the oven should enter into the danger more or the safety mode.

According to the cooking system described above, since the cooking appliance 1 is operated in accordance with whether or not a user is permissible, the user can use the cooking appliance 1 more safely and conveniently.

A method for controlling the cooking system will be described in detail as follows.

FIG. 4 is a flowchart of a method for controlling a cooking system according to an embodiment.

Referring to FIG. 4, in operation S1, the user manipulates the cooking appliance to start an RF tag recognition mode. The RF tag recognition mode may be initiated by pressing an RF tag recognition button 10 provided in the manipulator 7. In this case, the RF tags to be recognized are registered in the RF reading system prior to operation 31. That is, modes to be performed in accordance with whether a user is a child or an adult may be registered in the RF reading system in advance.

Next, in operation S2, the RF reader 3 is supplied with power supply to enter into a RF tag standby mode for monitoring whether an RF tag approaches. Then, in operation S3, if an RF tag is detected, a predetermined operation is initiated.

In operation S4, it is determined whether or not a user ID in the detected RF tag is a permissible user ID. In operation S5, when the user ID is the permissible user ID, the cooking system enters into a safety mode. Otherwise, in operation S6, the cooking system enters into a warning mode. As described above, an operation of the cooking appliance may vary according to whether the cooking system enters into a safety mode or a warning mode.

In operation S7, it is determined whether a predetermined time period has elapsed. While a preceding mode, that is, the safety mode or the warning mode, being still operated, the RF tag reading system returns to the RF tag recognition mode. When the predetermined time period has elapsed, the RF tag reading system will progress to next operation S8. The predetermined time period may be an adequate time period for a child or an adult to withdraw from the cooking appliance. In operation S8, it is determined whether the RF tag recognition mode is in progress. When the RF tag recognition mode is in progress, the RF tag reading system enters into the RF tag standby mode S2. When the RF tag recognition mode is stopped by an order of a user, the RF tag recognition mode is terminated.

In operation S7, since it is determined whether a current mode of the cooking appliance will be maintained, it is possible to save power unnecessarily consumed in the warning mode and the safety mode.

MODE FOR THE INVENTION

Although this embodiment has been described as an example, another embodiment will be further described in the present disclosure as follows.

First, when an RF tag corresponding to a warning mode and an RF tag corresponding to a safety mode approach a cooking appliance at the same time, the cooking appliance may be configured to enter into a safety mode.

Also, an operation status of the cooking appliance according to this embodiment is classified into two types of the safety mode and the warning mode, but not limited thereto. Besides the safety mode and the warning mode, the cooking appliance may be configured to enter into an operation initiation mode, in which the cooking appliance is forcibly operated with respect to a specific RF tag. The cooking appliance may be also configured to enter into an off mode, in which the cooking appliance is forcibly turned off with respect to another specific RF tag. As a result, various modes in accordance with RF tags may be provided in the cooking appliance without any limitation to the foregoing safety and warning modes.

Furthermore, the cooking appliance may be configured to enter into a main-use mode on the basis of information recorded in the memory 14 when the cooking appliance detects a specific user such as a housewife approaching the cooking appliance.

INDUSTRIAL APPLICABILITY

According to embodiments of the present disclosure, a user can use a cooking appliance more conveniently and safely since the cooking appliance may allow or disallow the user to operate the cooking appliance according to information of RF tags carried by the user.

Also, since the cooking appliance can be operated in various predetermined modes without any manipulations of the user, the user can use the cooking appliance more conveniently.

The invention claimed is:

1. A cooking system comprising:

a first radio frequency tag having a first user identification;

a second radio frequency tag having a second user identification;

a cooking appliance with a radio frequency reader detecting when one of the first and second radio frequency tags approaches, the cooking appliance initiating a predetermined mode when the one of the first and second radio frequency tags is detected;

a radio frequency tag recognition button in a manipulation unit of the cooking appliance, the radio frequency tag recognition button determining whether the radio frequency reader initiates a radio frequency tag reading operation to recognize the one of the first and second radio frequency tags;

a memory for storing user identifications; and a controller for controlling the cooking appliance, wherein the controller determines whether the transmitted user identification matches one of the user identifications recorded in the memory, wherein, in accordance with the user identification, modes, which the cooking appliance enters into, are predefined in the memory, wherein, when the controller determines that the radio frequency reader detects the first radio frequency tag, the cooking appliance enters into a safety mode, and wherein, when the controller determines that the radio frequency reader detects the second radio frequency tag, the cooking appliance enters into a warning mode.

2. The cooking system according to claim 1, wherein a door of the cooking appliance is locked during the warning mode.

3. The cooking system according to claim 1, wherein one of a warning image and a warning sound is generated during the warning mode.

4. The cooking system according to claim 1, wherein the cooking appliance is turned off during the warning mode.

5. The cooking system according to claim 1, wherein a door-locking unit of the cooking appliance is released during the safety mode.

6. The cooking system according to claim 1, wherein main power of the cooking appliance is turned on during the safety mode.

7. The cooking system according to claim 1, wherein a message saying wait for a user's instruction for the cooking appliance is outputted during the safety mode.

8. The cooking system according to claim 1, wherein a sensitivity of the radio frequency reader is adjustable.

9. The cooking system according to claim 1, wherein the radio frequency tag recognition button is manipulated in a different manner from manners in which other buttons are manipulated.

10. A cooking system comprising:

a first radio frequency tag comprising a first user identification;

a second radio frequency tag comprising a second user identification; and a cooking appliance changing an operation mode for each radio frequency tag, the cooking appliance comprising:

a radio frequency reader detecting approaching of one of the first and second radio frequency tags;

a memory for storing user identifications in which a predetermined operation mode is designated for each user identification; and a controller matching the user identification read from the radio frequency reader with user identification stored in the memory, and differently controlling the cooking appliance according to a operation mode, and the operation mode comprising a warning mode and a safety mode, wherein, in accordance with the user identifications, modes, which the cooking appliance enters into, are predefined in the memory, wherein, when the controller determines that the radio frequency reader detects the first radio frequency tag, the cooking appliance enters into a safety mode, and wherein, when the controller determines that the radio frequency reader detects the second radio frequency tag, the cooking appliance enters into a warning mode.

11. The cooking system according to claim 10, wherein the cooking appliance stops operating, and/or locks a door of the cooking appliance, and/or generates a warning sound and/or generates a warning image, during the warning mode.

12. The cooking system according to claim 10, wherein the cooking appliance waits for a manipulation of the user, or main power is applied to the cooking appliance during the safety mode.

13. A method for controlling a cooking system, the method comprising:

recognizing a radio frequency tag;

reading user information from the recognized radio frequency tag;

determining whether to operate a cooking appliance at least in a safety mode or in a warning mode using the user information; and operating the cooking appliance in the determined mode, wherein, when the radio frequency reader detects that the detected radio frequency tag has a first user identification, the cooking appliance enters into a safety mode, and wherein, when the radio frequency reader detects that the detected radio frequency tag has a second user identification, the cooking appliance enters into a warning mode.

14. The method according to claim 13, further comprising:

performing a radio frequency tag standby mode before the recognizing of the radio frequency tag;

determining whether the radio frequency tag is recognized again after the cooking appliance operates in the determined mode for a predetermined time; and performing one of the safety mode and the warning mode when the radio frequency tag is recognized, otherwise entering into the radio frequency tag standby mode.

15. The method according to claim 13, wherein the safety mode is a mode for preparing an operation of the cooking appliance, the warning mode is a mode for inhibiting the cooking appliance from operating, and the radio frequency tag standby mode is a mode during which power is applied to at least a radio frequency reader of the cooking appliance.

16. The method according to claim 13, wherein the determined mode is maintained for a determined time.

17. The method according to claim 13, further comprising registering at least one of the radio frequency tags before the recognizing of the radio frequency tag.

18. The method according to claim 13, wherein a door of the cooking appliance is locked during the warning mode.

19. The method according to claim 13, wherein main power of the cooking appliance is turned on during the warning mode.

* * * * *